US006516494B2

(12) United States Patent
Nakamoto et al.

(10) Patent No.: US 6,516,494 B2
(45) Date of Patent: Feb. 11, 2003

(54) ADJUSTABLE DOOR HINGE

(75) Inventors: Yusho Nakamoto, Hiroshima (JP); Katsunori Sako, Hiroshima (JP); Kiminori Kubo, Hiroshima (JP)

(73) Assignee: Kabushiki Kaisha Juken Sangyo, Hatsukaichi (JP)

( * ) Notice: Subject to any disclaimer, the term of this patent is extended or adjusted under 35 U.S.C. 154(b) by 19 days.

(21) Appl. No.: 09/756,058

(22) Filed: Jan. 8, 2001

(65) Prior Publication Data

US 2001/0011406 A1 Aug. 9, 2001

(30) Foreign Application Priority Data

Feb. 8, 2000 (JP) ..... 2000-030671

(51) Int. Cl.[7] ..... E05D 7/12

(52) U.S. Cl. ..... 16/271; 16/236; 16/238; 16/241; 16/245; 16/254

(58) Field of Search ..... 16/134, 236, 237, 16/246, 149, 271, 241, 238, 245, 254; 49/381

(56) References Cited

FOREIGN PATENT DOCUMENTS

| | | |
|---|---|---|
| JP | 48-59243 | 8/1973 |
| JP | 55-16171 | 2/1980 |
| JP | 57-68482 | 4/1982 |
| JP | 58-195763 | 12/1983 |
| JP | 59-10474 | 1/1984 |
| JP | 59-128876 | 1/1984 |
| JP | 59-146477 | 9/1984 |
| JP | 59-175573 | 11/1984 |
| JP | 04-41075 | 4/1992 |
| JP | 04-52177 | 5/1992 |
| JP | 05-75378 | 10/1993 |
| JP | 07-252974 | 10/1995 |
| JP | 08-135287 | 5/1996 |
| JP | 09-317300 | 12/1997 |
| JP | 10-246055 | 9/1998 |
| JP | 11-270213 | 10/1999 |
| WO | WO90/10775 A | 9/1990 |
| WO | WO99/61738 A | 12/1999 |

OTHER PUBLICATIONS

Patent Abstracts of Japan, vol. 015, No. 178 (M–1110), May 8, 1991, and JP 03–039581 A (Jiyuuken Sangyo: KK), Feb. 20, 1991—Abstract only.

Office Action issued from the Japanese Patent Office in a counterpart Japanese Appln. No. 2000–30671 and English translation.

*Primary Examiner*—Anthony Knight
*Assistant Examiner*—Lisa Bannapradist
(74) *Attorney, Agent, or Firm*—Frishauf, Holtz, Goodman & Chick, P.C.

(57) ABSTRACT

A hinge is provided which includes a frame-side base member 41 adapted to be attached to an open frame 10 and a door-side base member 42 adapted to be attached to a door 20. The frame-side base member 41 is connected to a first plate 31 and the door-side base member 42 is connected to a second plate 32 which is hinge connected to the first plate 31, for holding the door 20 so as to be capable of rotating. The second plate 32 is separable from the door-side base member 42. The door-side base member 42 is shaped to be symmetrical about the vertical center line of the door edge, and is imbedded in the edge of the door 20 without any protrusions from the door 20. Further, the door-side base member 42 is provided with a slit 44 which penetrates the member 42 in the width direction of the door 20 and into which the second plate 32 can be inserted from both the front and back sides of the door 20. There is also provided a lock apparatus to lock the second plate 32 inserted into the slit 44.

4 Claims, 10 Drawing Sheets

ADJUSTABLE DOOR HINGE

BACKGROUND OF THE INVENTION

1. Field of the Invention

The present invention relates to a hinge, half of which is attached to an open frame and the other half is attached to a door, for holding the door so as to be capable of rotating. The hinge is advantageous for a use in a double hinged door because there is no need to reposition the hinge when the door is reversed.

2. Description of the Related Art

Conventionally, there exists a popular type of door hinge wherein half of the hinge is attachable to an open frame and the other half is attachable to a door, and wherein each half can be connected to and disconnected from the other half as either half of both halves is/are moved in a vertical direction against each other. This type of hinge includes a "left-type" and a "right-type" wherein the former is attached to the left side of the door and the latter is attached to the right side of the door. This type of hinge is structured so as to be attached to either the front side or the back side in the door edge, so that it can be used only as either the "left-type" or the "right-type".

Consequently, in general, when ordering a door, it is required to designate if the door is the "left-type" or the "right-type", and accordingly, the "left-type" or the "right-type" hinge is attached to an open frame and the door prior to shipping. And, a marking of either the "left-type" or the "right-type" is applied on a package of the open frame and the door during the packing process. However, despite an effort in the marking, unordered type of open frames and doors are sometimes shipped by a mistake. Further, it is necessary to produce both the "left-type" and the "right-type" products in each model, so that a maker of the products must run operations, calculating demands and production ratio of the "left-type" and the "right-type".

When there is a requirement of reversing an opening direction of a door (which referrers a direction toward which a door is opened) in such occasion as a renovation of a house, it is impossible to reverse the direction if the door is provided with the above-described conventional hinge.

There have been provided hinges that can be used both as the left-type and the right-type by the applicant of the present application and others. (See, for example, Japanese Provisional Utility Model Publication Nos. 4-52177, 4-41075, 59-175573, 59-146477, 59-128876, 59-10474 and 58-195763, Japanese Provisional Patent Publication Nos. 57-68482, 55-16171 and 48-59243, Japanese Provisional Utility Model Publication No. 5-75378, Japanese Provisional Patent Publication No. 10-246055, and Japanese Provisional Utility Model Publication No. 5-75378.)

As a hinge used both as the left-type and the right-type, there has been provided so called a flag-shaped hinge. The flag-shaped hinge, as illustrated in FIG. 8, comprises a frame-side half 91 having a vertical axis 66, which is attached to an open frame and a door-side half 91 having a vertical sleeve 63 for receiving the vertical axis 66, which is attached to a door. The flag-shaped hinge is structured as such that either the frame-side half 91 or the door-side half 92 is turned over or turned upside down in order to use both as the left-type and the right-type.

Further, a hinge as illustrated in FIG. 9 (which is disclosed in Japanese Provisional Patent Publication Nos. 48-59243 and 59-128876) is structured as such that a pair of halves 95, each of which comprises a vertical sleeve 63, are coupled with a single vertical axis 66 above and below intervening a flange 67 in between. And, as illustrated in FIG. 10, the half 95 of the hinge is reversed and turned upside down in a same plane in order to reposition the vertical sleeve.

This type of hinge is structured as such that the door-side half is shaped symmetrical about the vertical center line of the door edge which the door-side-half is attached to in such a form that it does not close neither to the front side nor the back side of the door. Therefore, this hinge can be used both as the "left-type" and the "right-type" by rotating the door upon vertical axis of the door from side to side, repositioning the vertical axis 66 and the vertical sleeve 63 of the hinge to the side which the door is directed to open.

That is, when an opening direction of the door is to be reversed, first, the door-side half of the hinge should be removed from the door by detaching the set screws, and then it should be repositioned followed by a reversing operation or by other similar operations, and finally it should be reattached to the proper position of the door. With such operation, an opening direction of the door can be reversed from the left to the right or vise versa. However, there is a drawback in this art that it requires a lot of labor in detaching the set screws, reattaching the door and the like.

Further, if the set screws are not screwed tight enough or if they are screwed into holes which were formed as the set screws were unscrewed therefrom, the set screws lose their holding power and at worst the door may drop out of the open frame.

Consequently, it is too difficult to perform a repositioning operation with such type of hinges in the field, especially in a construction of a complex housing where a numerous number of doors are supposed to be attached in a shorter period of time. Such operation is in fact impossible to complete. Because of the above-mentioned reason, this type of conventional hinge is generally attached to a door prior to it is shipped, and a marking of the "left-type" or the "right-type" is applied on a package through a conventional manner, even though the hinge is basically structured as both types.

In addition, if the set screws (which are wood screws and are 30 mm to 40 mm in length and four to six of the screws are needed to obtain enough strength) are insufficiently attached, they tend to loosen as the door intermittently swings. Then, the door may indeed drop out of the open frame over the long term of use. In order to avoid such danger, when the conventional hinge is to be attached in the field, a power tool such as an electric screwdriver was used instead of a hand operated screwdriver. There is also a concern of decrease in a strength of the set screws caused by a worker of lower skill who fails to attach the set screws properly.

Further, since the hinge is repositioned in the door, there remains a lot of holes in the door where the set screws were once screwed into. Such remaining holes deteriorates the appearance of the door and the retentive of the wood screws as well.

Besides the above-described type of hinge, there is provided another type of hinge which is so called a horizontally connecting-disconnecting type, which is such that a door-side half of the hinge is provided with a opening mouth into which a horizontal member of a frame-side half is inserted along the width direction (which is the direction from the front side to the back side of the door or vise versa) of the door. This type of hinge is used both as the left-type and the right-type (See, for example, Japanese Provisional Patent Publication No. 9-317300).

According to this type of hinge, when an opening direction of the door is to be reversed in the field, it is unnecessary to reposition the door-side half of the hinge. However, the door may drop out of the open frame if set screws for the horizontal member loosen. Further, since the frame-side half of the hinge is not repositioned, the open frame is limited to use either as the left-type or the right-type. Therefore, it is required to produce the open frames of the left-type and the right-type as well.

When concerning a packing of a door, since each conventional hinge illustrated in FIGS. 8 to 10 has vertical sleeve 63 protruding out of the door, the hinge may be damaged during a shipping process and a package of such door becomes larger and complicated. As a door handle 61 is fixed to a door with a single screw, it is easy to detach the handle 61 from the door prior to shipments. Contrary to this, a hinge is fixed to a door with four to six of wood screws and there is required a considerable amount of time for detaching the hinge from the door, so that the hinge is generally attached to the door and is shipped in combination with the door.

That is, as illustrated in FIG. 10, since a vertical sleeve 63 of a hinge protrudes out of the door, the hinge is easily damaged and deformed.

Further, as illustrated in FIG. 11, there is needed a buffer material 102 for protecting the vertical sleeve 63 protruding out of the hinge besides a corrugated fiberboard for packing. Further, since there is created a hollow above the door except the area the vertical sleeve 63 is positioned, there needed to provide a packing material as such as a buffer material 103 for fixing the hollow. Therefore, the package of the door combined with the hinge becomes as twice thicker than the package of a door alone which is illustrated in FIG. 12, and it requires much more buffer material. Further, since there is created a large hollow in the package, if a number of packages are piled above and below, the piled packages become unstable and they may collapse especially when they are carried by such as a truck.

Further, according to the conventional hinge as illustrated in FIGS. 8 to 10, which is a type of hinge wherein a half of the hinge connects to and disconnects from the other half as either half is moved in a vertical direction against the other half, a vertical axis 66 is inserted into the vertical sleeve 63 as a door is moved downward after it is moved upward. Therefore, there is needed a space above the door, which should be longer than the vertical axis 66 in length. If there is not a space of more than 10 cm above the door, it is impossible to attach the door. Similarly, it is difficult to attach the door if the surroundings of the door is improper.

Therefore, an object of the present invention is to provide a hinge that can be used both as the "left-type" and the "right-type", overcoming the above-described drawbacks, thereby avoiding the need to produce both types of hinges and making it easy to pack and attach the hinges and other related parts in the field.

SUMMARY OF THE INVENTION

A hinge according to a first aspect of the present invention is characterized in that it comprises a frame-side base member 41 adapted to be fixed to an open frame 10 and a door-side base member 42 adapted to be fixed to a door 20, wherein the frame-side base member 41 is connected to a first plate 31 and the door-side base member 42 is connected to a second plate 32 which is hinged to the first plate 31, for holding the door 20 so as to be capable of rotating. The second plate 32 can be disconnected from the door-side base member 42. The door-side base member 42 is shaped to be symmetrical about the vertical center line of the door edge, and is imbedded in the edge of the door 20 without any portions thereof protruding from the door 20. Further, the door-side base member 42 is provided with a slit 44 which penetrates the member 42 in the width direction of the door 20 and into which the second plate 32 is insertable from both the front and back sides of the door 20. There is also provided a lock apparatus to lock the second plate 32 inserted into the slit 44.

A hinge according to a second aspect of the present invention is characterized in that, besides the first aspect of the present invention, the back end of the second plate 32 is connected to the back end of the first plate 31 with adjusting screws 37 capable of moving upward and downward. The front end of the first plate 31 is inserted into a longitudinal opening 43 formed in the frame-side base member 41, which is wider than the thickness of the first plate 31, and is connected to the frame-side base member 41 with adjusting screws 47, 49 capable of moving in the width direction of the first plate 31. The top end of the first plate 31 is connected to the frame-side base member 41 with an adjusting screw and an adjusting cam 45 capable of disconnecting.

A hinge according to a third aspect of the present invention is characterized in that, besides the first and second aspect of the present inventions, there is provided an opening 34 in the second plate 32 at the center of the top end. There is also provided a lock apparatus composed of an elastic protrusion 51, 52 which is compressed while it is pressed by the second plate 32 and extends when it faces the opening 34. The lock position is released by compressing the elastic protrusion 51, 52.

According to the first aspect of the present invention, the first plate, the second plate and the frame-side base member are separable from the door-side base member, and the combination can be connected to both the front and back sides of the door any number of times by inserting the second plate into the slit of the door-side base member by a one-touch operation. Therefore, the hinge according to the present invention can be used both as the left-type and the right-type corresponding to a request in the field.

A combination of the first plate, the second plate and the frame-side base member can be packed while they are disconnected from the door-side base member, and the door-side base member is imbedded in the door edge as such that no portions thereof protrudes out of the door, so that they can be transported in a stable posture.

According to the second aspect of the present invention, in addition to the advantages of the first aspect of the invention, the door can be moved in three directions, including a vertical direction relative to the open frame, a horizontal direction along the door surface when the door is closed, and a width (thickness) direction along the door edge when the door is closed. Therefore, the position of the door can be fine adjusted when and after the door is attached.

According to the third aspect of the present invention, in addition to the advantages of the first and second aspects of the invention, there is provided a lock apparatus composed of merely a elastic protrusion which comprises, for example, a coil spring, an engaging member and a blade spring, so that the lock apparatus is simple in structure.

DESCRIPTION OF PREFERRED EMBODIMENT

Figure 1:
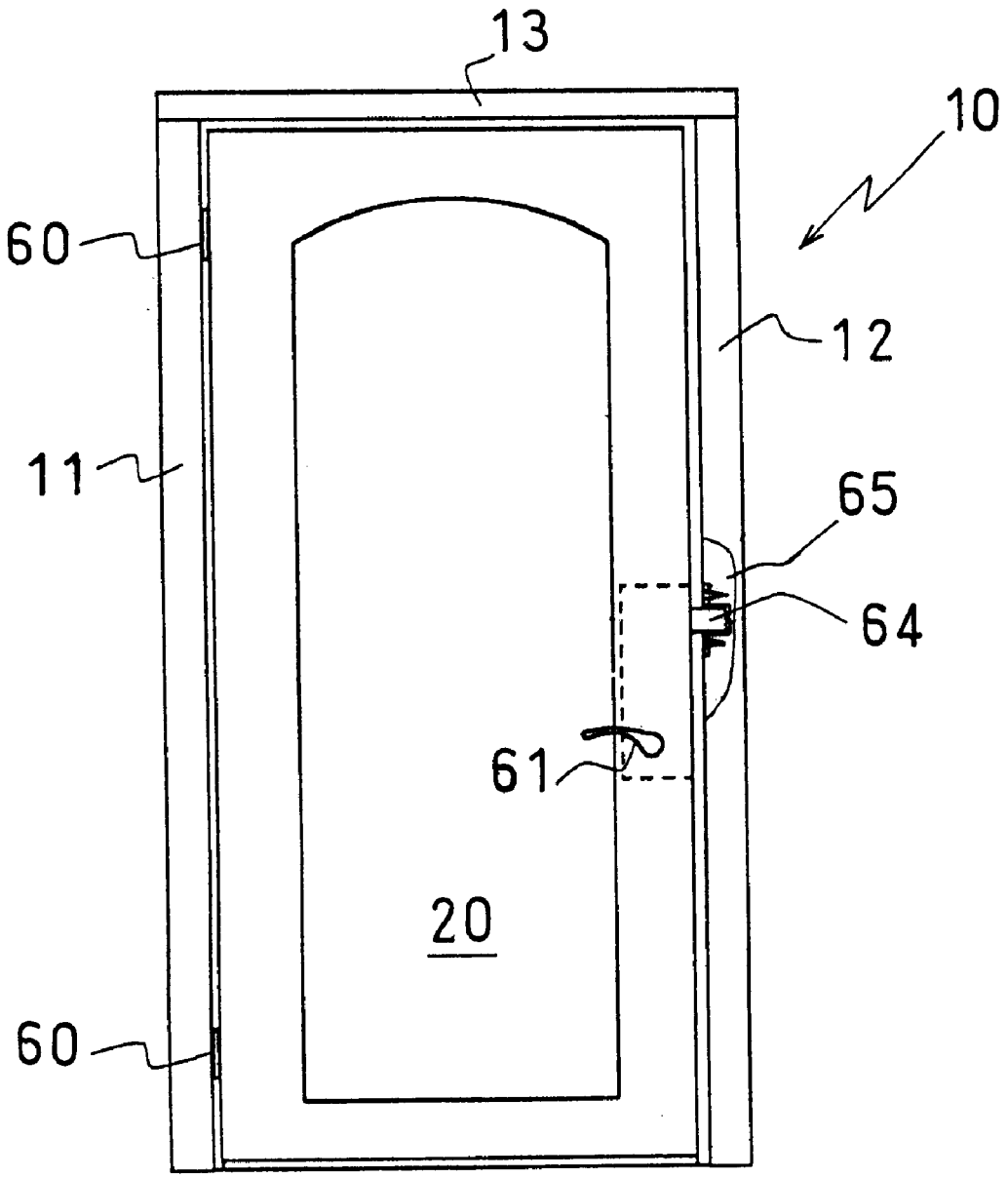
FIG. 1 is an elevation view that illustrates a door.

A preferred embodiment of the present invention will be described referring to the drawings.

As illustrated in FIG. 1, an open frame 10 comprises a hinge-side vertical member 11, a latch-side vertical member and an upper frame member 13. The hinge-side vertical member 11 is provided with a pair of hinges 60 at upper and lower sides thereof for holding a door 20 capable of rotating. The latch-side vertical member 12, whose length is equal to that of the hinge-side vertical member 11, is provided with a latch receiver 65 for receiving a latch 64 which protrudes from the door 20 when a latch 64 is rotated. The upper frame member 13 is positioned between the hinge-side vertical member 11 and the latch-side vertical member 12 at the upper ends thereof, connecting both members 11, 12.

Figure 2:
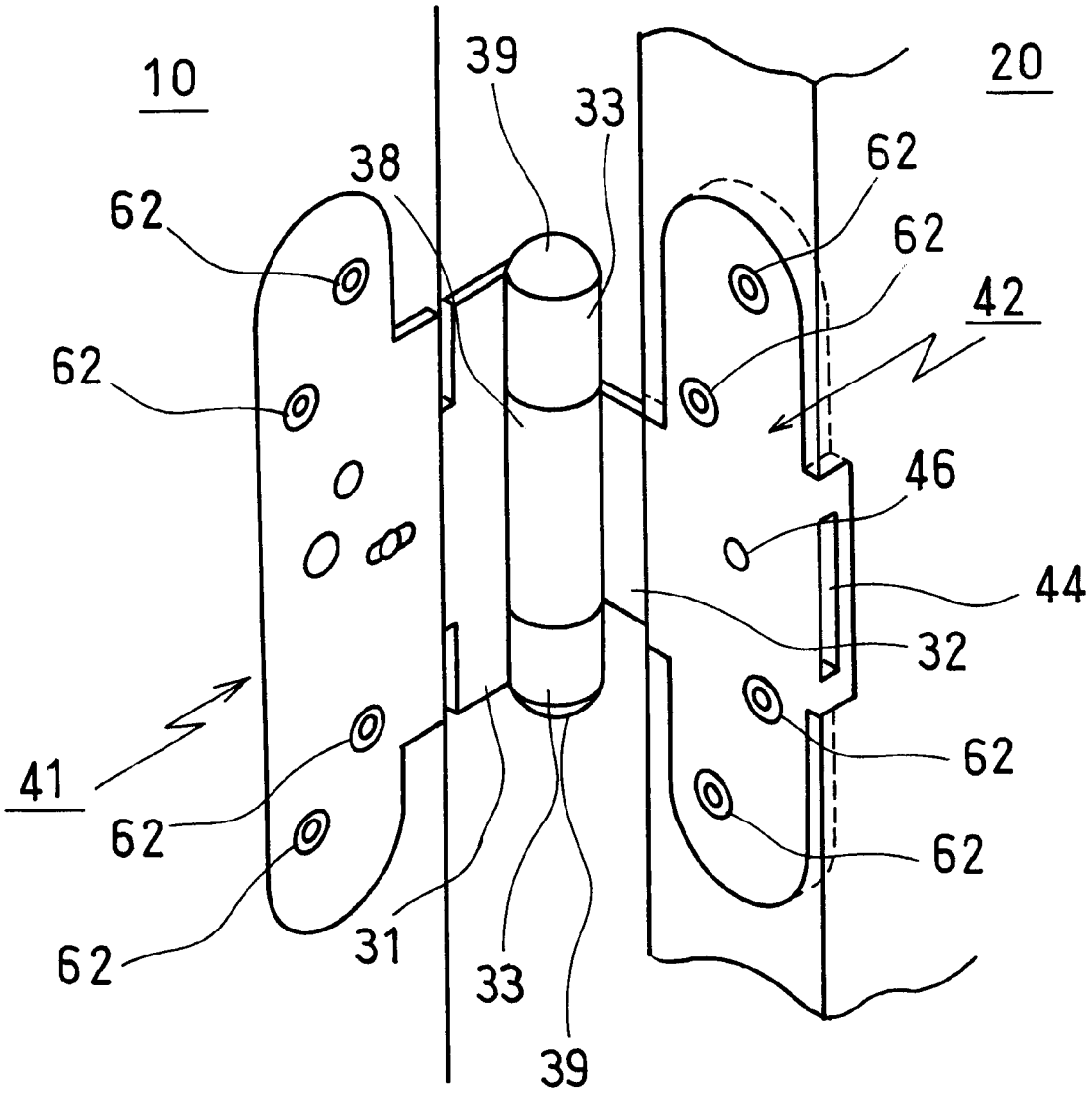
FIG. 2 is a perspective view that illustrates a preferred embodiment of a hinge according to the present invention.
Figure 3:
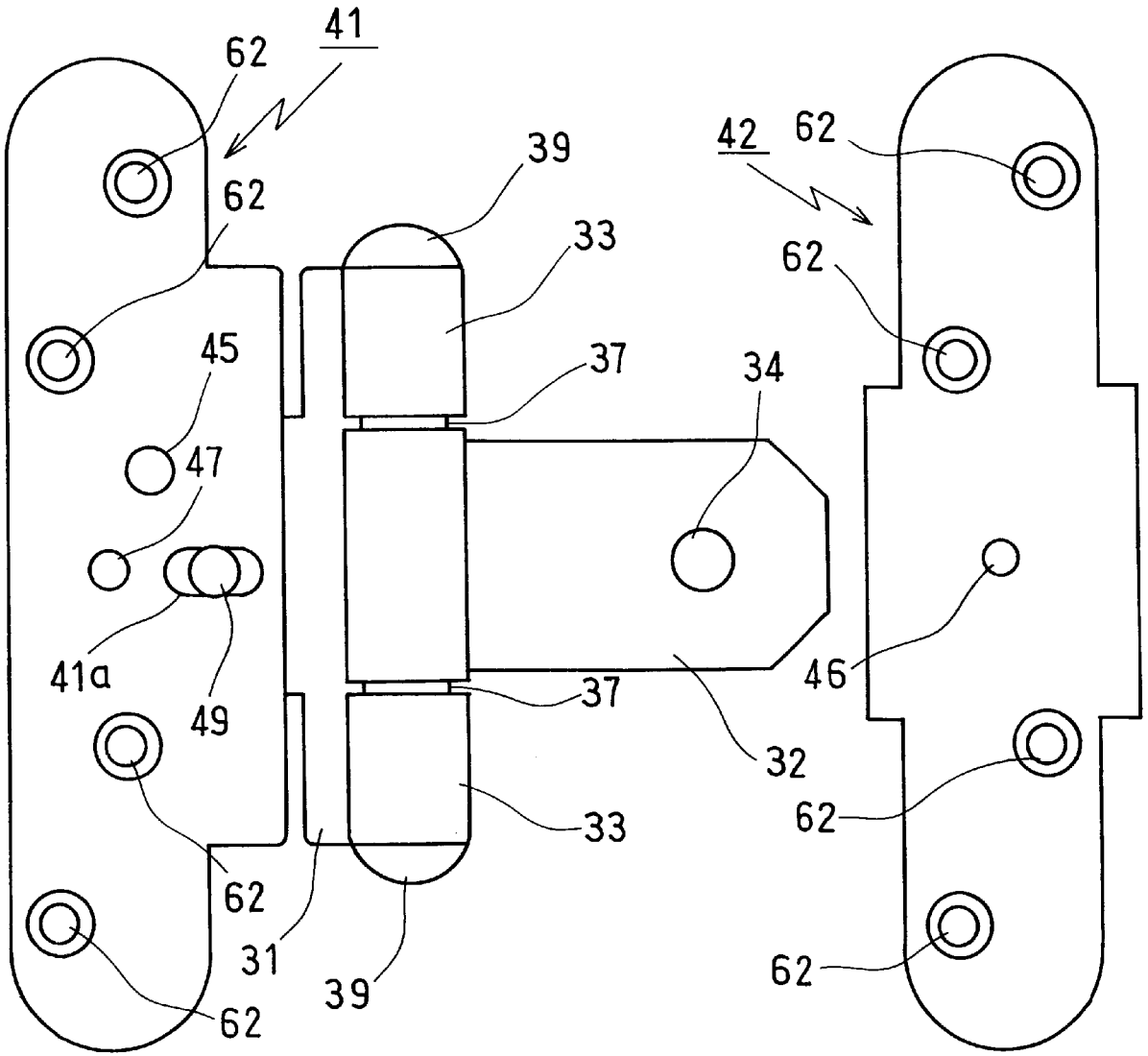
FIG. 3 is an elevation view that illustrates a preferred embodiment according to the present invention in which a second plate is about to be inserted into a door-side base member.
Figure 4:
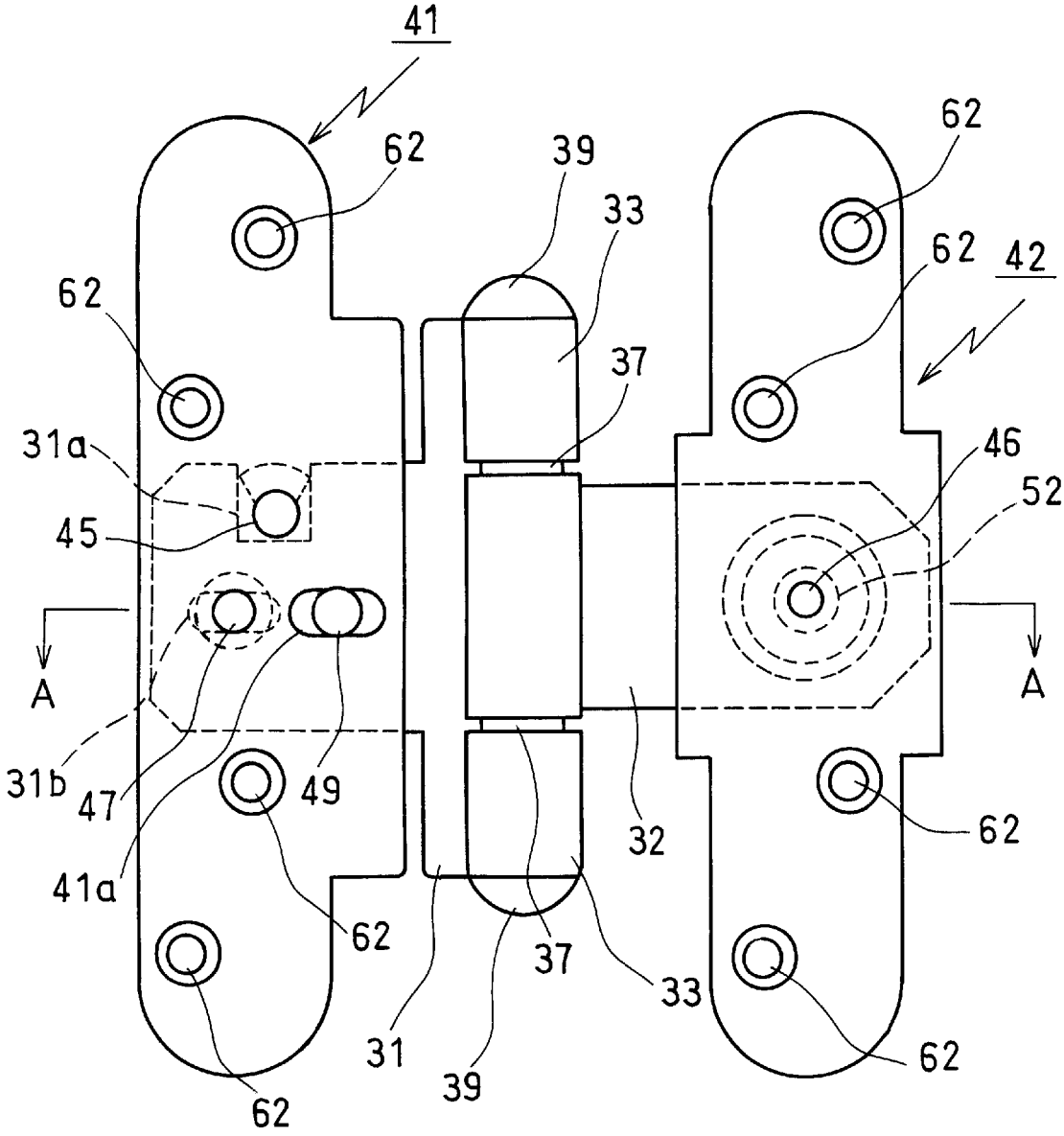
FIG. 4 is an elevation view that illustrates a preferred embodiment of the present invention in which a second plate is inserted into a door-side base member.

As illustrated in FIGS. 2 to 4, each hinge 60 is composed of a first plate 31 and a second plate 32, which are hinge connected with each other at the back ends thereof, a frame-side base member 41 which is connected to the front end of the first plate 31 and a door-side base member 42 which is connected with the front end of the second plate 32. With such structured hinge 60, the door 20 is held to the open frame 10 capable of rotating. As illustrated in FIG. 2, the frame-side base member 41 is connected to the open frame 10 and the door-side base member 42 is connected to the edge of the door 20.

Specifically, the door-side base member 42 is shaped to be symmetrical relative to the width direction of the door 20 (which is the direction directed through the front to the back of the door 20), and the door-side base member 42 is imbedded into the door 20 with screws 62 without any portions thereof protruding from the door 20. That is, the width (the maximum width) of the door-side base member 42 is equal to the width of the door edge, so that the door-side base member 42 does not protrude out of the door edge toward the open frame 10.

Further, the door-side base member 42 comprises a slit 44 which passes through the central part of the member 42 in the width direction of the door 20. The slit 44 is capable of receiving the front end of the second plate 32, which is inserted into the slit 44, from both the front side (which is shown in the right side in FIGS. 3 and 4) and the back side (which is shown in the left side in FIGS. 3 and 4) of the door 20.

There is provided a lock apparatus for locking the second plate 32 after the plate 32 is inserted into the slit 44. Although it is not shown in the drawings, there may be provided a cap over an opening of the slit 44, which is left open as the second plate 32 is inserted into the other side of the opening. The lock apparatus is composed of an elastic protrusion.

Figure 5:
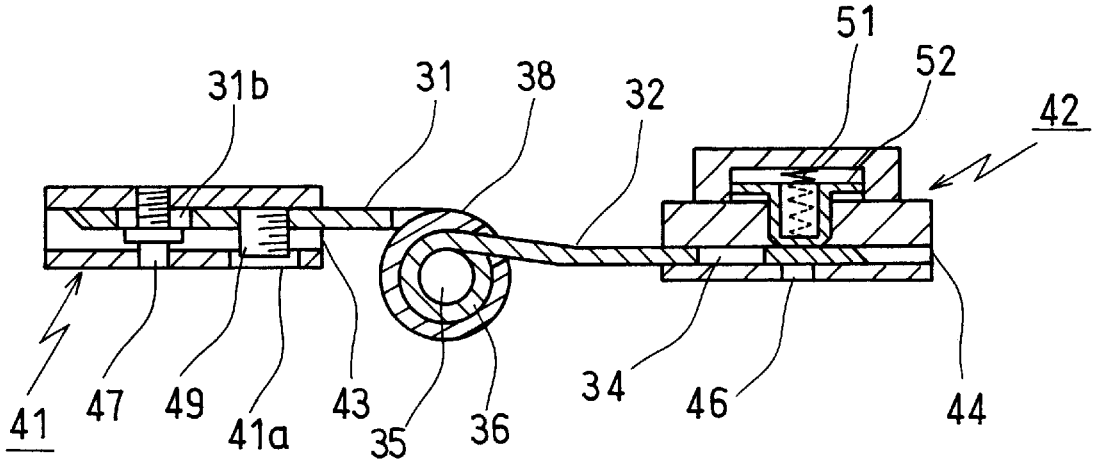
FIG. 5 is a sectional view that illustrates a hinge along line A—A in FIG. 4 in which a second plate is about to be engaged with a door-side base member.
Figure 6:
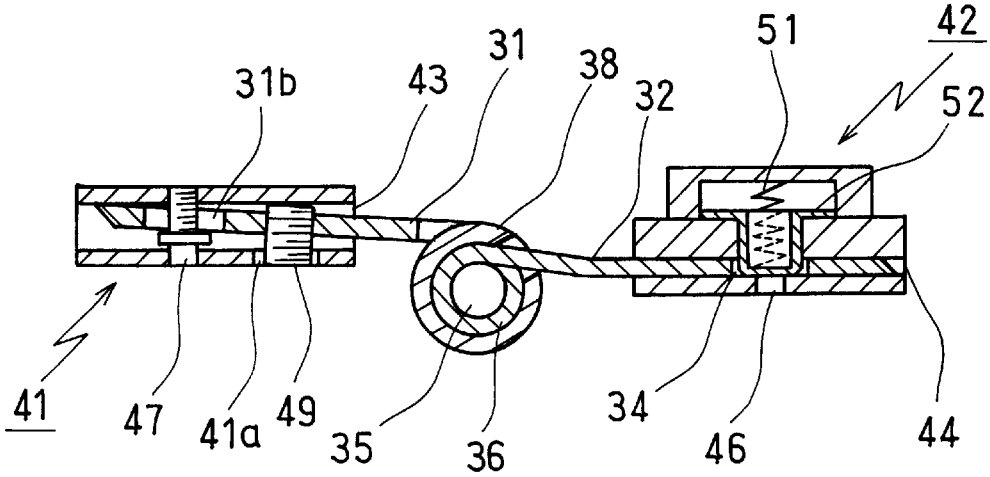
FIG. 6 is a sectional view that illustrates a hinge along line A—A in FIG. 4 in which a second plate is engaged with a door-side base member.

The elastic protrusion is compressed while it is pushed by the second plate 32 inserted into the slit 44, and it extends as it faces to a opening 34 as the second plate 32 continues to slide in the slit 44, and the elastic protrusion engages with the opening 34. More specifically, as illustrated in FIGS. 5 and 6, the elastic protrusion is composed of a coil spring 51 and an engaging member 52 which protrudes toward the width direction of the door-side base member 42 by an elastic force of the coil spring 51. FIG. 5 shows a posture where the coil spring 51 is compressed and the engaging member 52 is pushed backward, while FIG. 6 shows a posture where the coil spring 51 extends and the engaging member 52 engages with the second plate 32.

The periphery of the front end of the engaging member 52 is tapered in order to allow the elastic protrusion to smoothly engage with the second plate 32 both from the front side and back side of the door 20. A blade spring may be used as an elastic protrusion, which has a combined function of the coil spring 51 and the engaging member 52.

With the above-mentioned structure, the second plate 32, which is connected to the frame-side base member 41, at the front end thereof, can be connected to the door-side base member 42 by a one-touch operation.

There is provided an opening 46 in the door-side base member 42 at an area opposing to the engaging member 52 through the slit 44. In order to release an engagement of the engaging member 52 with the opening 46, the top end of a stick such as a screwdriver should be inserted into the opening 46, pushing the engaging member 52 backward. With such operation, the extended coil spring 51 is compressed and the engaging member 52 moves backward, releasing the engagement.

Figure 7:
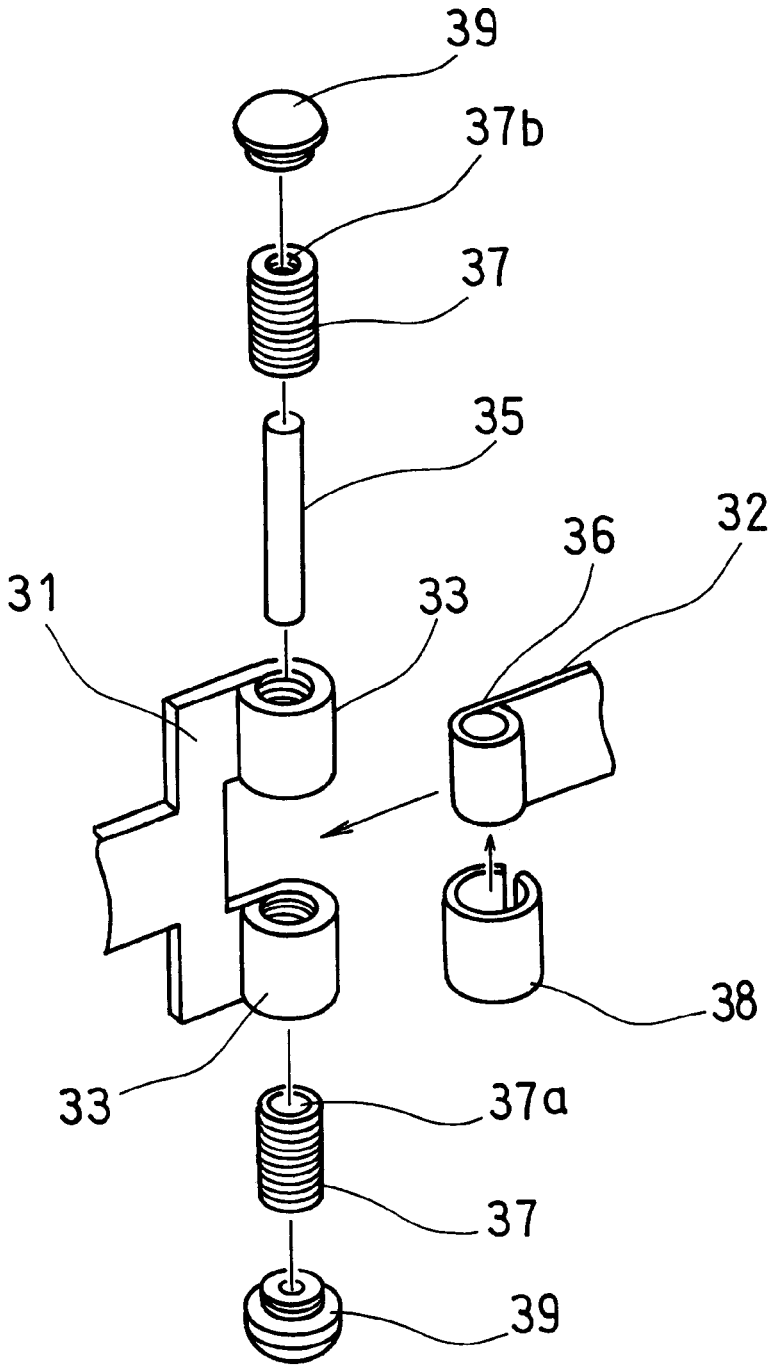
FIG. 7 is an exploded perspective view that illustrates a hinge connecting portions of a first plate and a second plate.
Figure 8:
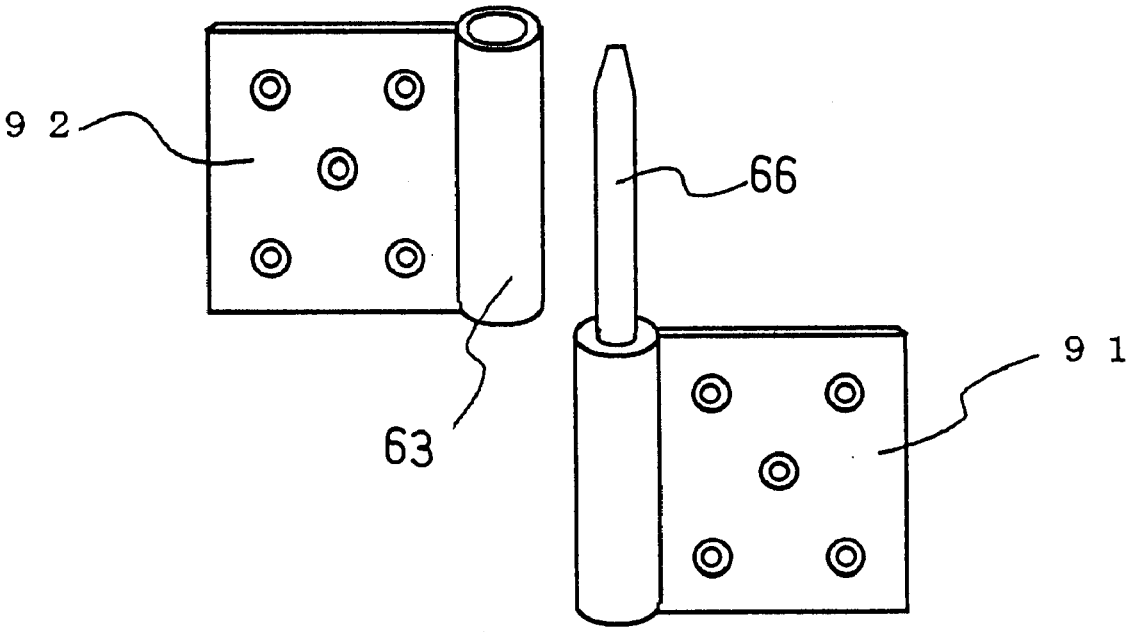
FIG. 8 PRIOR ART
FIG. 8 is a perspective view that illustrates an example of a conventional art.
Figure 9:
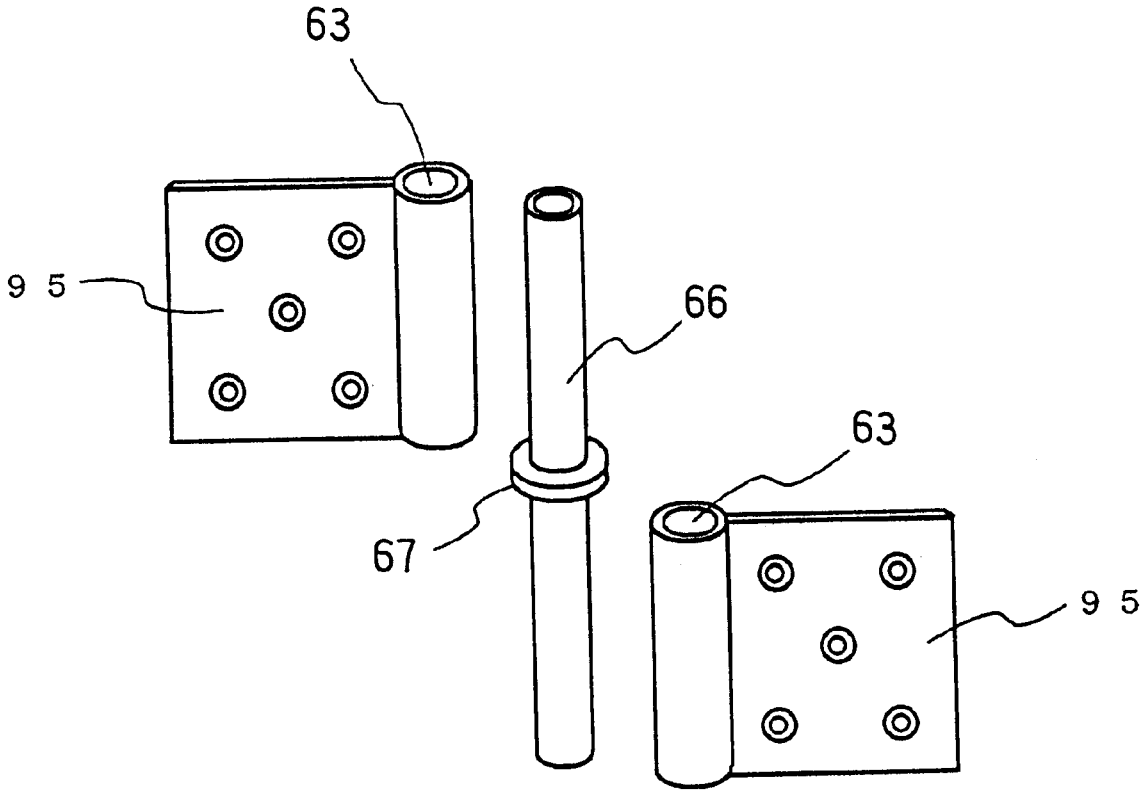
FIG. 9 PRIOR ART
FIG. 9 is a perspective view that illustrates another example of a conventional art.
Figure 10:
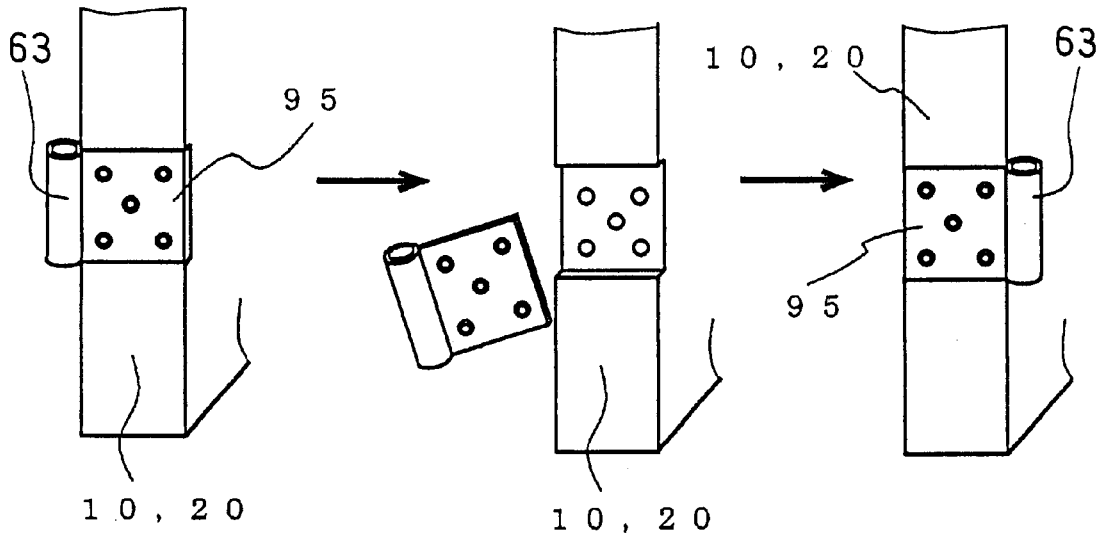
FIG. 10 PRIOR ART
FIG. 10 is a perspective view that illustrates the hinge as shown in FIG. 9 which is being repositioned.
Figure 11:
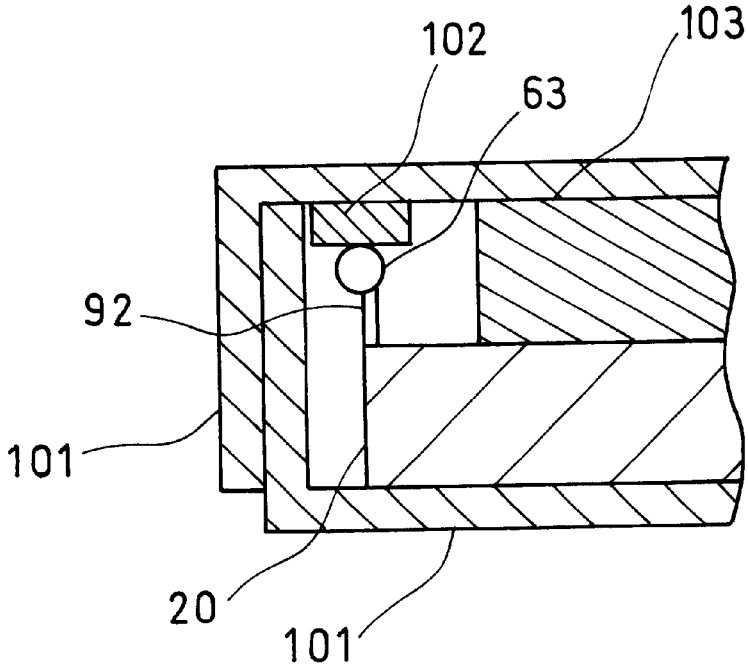
FIG. 11 PRIOR ART
FIG. 11 is a sectional view that illustrates a package of a door in combination with a conventional hinge.

As illustrated in FIG. 7, there is provided a tubular member 36 at the back end of the second plate 32. A collar 38 having a helical groove fits around the tubular member 36, and the tubular member 36 in combination with the collar 38 is situated between the axis receivers 33, 33, which are provided at the back end of the first plate 31 about and below an intervening gap. A vertical axis 35 capable of rotating is inserted in the axis receivers 33, 33. The inside surface of the axis receivers 33, 33 are threaded, and adjusting screws 37, 37 are screwed into the receivers 33, 33 over the vertical axis 35 in the upward and downward directions, respectively. There is provided a concave depression 37*a* at one end of each adjusting screw 37 for receiving the vertical axis 35, and there is provided an opening 37*b* at the other end of the screw 37 for receiving a hexagonal wrench. Each adjusting screw 37 is arranged to be longer than its corresponding axis receiver 33, and by moving the adjusting screw 37 in a vertical direction, thereby pushing the corresponding tubular member 36, the back end of the second plate 32 moves in the vertical direction relative to the first plate 31. Having such function, the door 20 after being secured to the open frame 10 can be fine adjusted in the vertical direction. Each adjusting screw 37 is provided with a decoration cap 39 on the top or bottom thereof.

The front end of the first plate 31 is inserted into a longitudinal opening 43 of the frame-side base member 41. As illustrated in FIG. 4, the first plate 31 is provided with a concave 31*a* at the front end thereof, in which an adjusting cam 45 attached to the frame-side base member 41 is positioned. By rotating the adjusting cam 45, the first plate 31 moves closer to or away from the frame-side base member 41. Consequently, it is possible to fine adjust the position of the door in the cross direction (which is the width direction of the door 20 when it is closed). In place of the adjusting cam 45, an adjusting screw may be provided in the frame-side base member 41 and a groove may be provided in the first plate 31, engaging the adjusting screw with the groove.

As illustrated in FIGS. 5 and 6, the width of the longitudinal opening 43, where the front end of the first plate 31 is inserted, is arranged wider than the thickness of the first plate 31. (In this preferred embodiment, the width of the opening 43 is arranged twice as wide as the thickness of the first plate 31.) Therefore, the first plate 31 can move in the width (thickness) direction in the longitudinal opening 31*b*. The top front end of the first plate 31 is fixed to the frame-side base member 41 with a set screw 47, and the back front end thereof is provided with an adjusting screw 49. By adjusting the adjusting screw 49, the first plate 31 moves in the width (thickness) direction of the first plate based on the supporting point where the set screw 47 is attached. Consequently, the door 20 can be fine adjusted in the horizontal direction relative to the open frame 10. (The horizontal direction indicates a direction which is a right angle in relative to both the width and vertical directions of the door 20 when it is closed.) FIG. 5 shows a posture that the edge of the door 20 is closer to the frame-side base member 41 when the door 20 is closed, as the first plate 31 is moved toward inside (upper side in FIG. 5) of the frame-side base member 41. FIG. 6 shows a posture where the edge of the door 20 is apart from the frame-side base member 41 when the door 20 is closed, as the first plate 31 is moved toward the outside (downside in FIG. 5) of the frame-side base member 41.

Both an opening 31*b* of the first plate 31 into which the set screw 47 penetrates and an opening 41*a* of the frame-side base member 41 into which the adjusting screw 49 is placed are formed long sideways. Therefore, when the set screw 47 is loosened, the front end of the first plate 31 combined with the adjusting screw 49 becomes capable of moving toward or backward from the frame-side base member 41 by an adjustment of the adjusting cam 45.

According to the above-described hinge, the combination of the first plate 31, the frame-side base member 41 connected to the first plate 31 and the second plate 32 can be easily connected to and disconnected from the door-side base member 42 from both the front and back sides of the door. Therefore, the hinge can be used both as the left-type and the right-type, corresponding to a requirement in the field. According to this hinge, the frame-side base member 41 should be attached to the open frame 10 at a desired position with screws 62.

Figure 12:
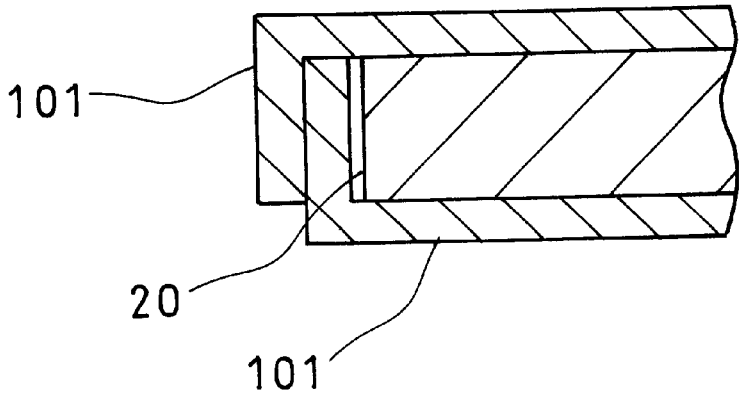
FIG. 12 PRIOR ART
FIG. 12 is a sectional view that illustrates a package of a mere door.

Since the door-side base member 42 is imbedded into the door 20 and no portions thereof protrude out of the door 20, the package of the door 20 in combination with the door-side base member 42 is as thin as a package of a door alone which is illustrated in FIG. 12. Therefore, packing the door 20 in combination with the door-side base member 42 is easy and no particular buffer material is required in the package.

According to the first aspect of the present invention, a first plate, a second plate and a frame-side base member are separable from a door-side base member, and the combination can be connected to both the front and back sides of the door by inserting the second plate into a slit of the door-side base member any number of times by a one-touch operation. Therefore, the hinge according to the invention can be used both as a left-type and a right-type, corresponding to a requirement in the field. Further, when the hinge is to be reversed, unlike as in the prior art, the door-side base member is allowed to stay in position and it is unnecessary to remove and reattach wood screws that fasten the door-side base member. Therefore, it is easy to apply the hinge, and it is unnecessary to worry about demerits such as a deficiency in the retention of wood screws.

The combination of the first plate, the second plate and the frame-side base member is packed while it is disconnected from the door-side base member, so that the combination is stabilized and prevented from being damaged by an outer force while it is transported. In the transportation process, no particular buffer materials are required, so that the cost needed for the transportation can be kept low. Further, the door-side base member is imbedded into the door so that no portions thereof protrude from the door, so that the combination of the door-side base member and the door is stabilized when they are transported.

Further, according to this invention, a door combined with the door-side base member can be easily connected to the frame-side base member attached to the open frame even if there are some obstacles around the door and even if there is not enough space over the door. This is due to the fact that with the hinge of the present invention, the second plate of the combination can be inserted into the slit of the door-side base member in a horizontal direction (and not in a vertical direction). Whereas, in the above-described conventional hinge, which has to be moved in a vertical direction for engagement and disengagement, a door must be moved downward just after it is moved upward in order to insert the vertical axis of the open frame into the vertical tubular member. Therefore, there is needed an open space over the door, which must be wider than the length of the vertical axis, that is at least 10 cm. Otherwise, it is difficult to attach the door.

According to a second aspect of the present invention, in addition to the advantages of the first aspect of the invention, there are provided an adjusting screw and an adjusting cam in a frame-side base member. Therefore, with the hinge of the present invention, a door can be moved in a vertical direction relative to the open frame, and a horizontal direction and a width (thickness) direction of the door when the door is closed. Therefore, it is advantageous to fine adjust the door when and after the door is attached.

According to a third aspect of the present invention, in addition to the advantages of the first and second aspects of the invention, there is provided a lock apparatus which is composed of a elastic protrusion which comprises, for example, a coil spring, an engaging member and a blade spring. The lock apparatus is simple in structure, and it is unlocked with an easy operation by simply compressing the elastic protrusion, which are advantageous in producing the hinge according to the present invention.

We claim:

1. A hinge comprising:

a frame-side base member which is adapted to be attached to an open frame;

a door-side base member which is adapted to be attached to a door;

a first plate to which the frame-side base member is connected;

a second plate which is hinge connected to the first plate and to which the door-side base member is connected;

a slit which is provided in the door-side base member in a width direction of the door, and into which the second plate can be inserted and removed from both a front side of the door and a back side of the door; and a lock apparatus provided in the door-side base member to lock the second plate into the slit when the second plate is inserted in the slit;

wherein a back end of the second plate is connected to the back end of the first plate with at least one adjusting screw capable of moving upward and downward, thus enabling the door to be moved in a vertical direction for fine adjustment;

wherein a front end of the first plate is inserted into a longitudinal opening formed in the frame-side base member which is wider than a thickness of the first plate, and the front end of the first plate is connected with the frame-side base member with at least one adjusting screw capable of moving forward and backward, thus enabling the door to be moved in a horizontal direction for fine adjustment when the door is closed; and wherein a top end of the first plate is connected to the frame-side base member with one of an adjusting screw and an adjusting cam capable of moving toward and away from the frame-side base member, thus enabling the door to be moved in a back-and-forth cross direction for fine adjustment when the door is closed.

2. The hinge according to claim 1, wherein the door-side base member is shaped to be symmetrical about a vertical center line of an end face of the door, and is adapted to be imbedded in the end face of the door without any portions of the door-side base member protruding from the door.

3. The hinge according to claim 1, wherein an opening is provided in the second plate, and the lock apparatus comprises an elastic protrusion which is adapted to be compressed when pressed by the second plate and to extend into the opening provided in the second plate when the elastic protrusion faces the opening to thereby achieve locking.

4. The hinge according to claim 3, wherein the opening in the second plate is formed at a center of a top end of the second plate, and locking of the lock apparatus is adapted to be released by compressing the elastic protrusion.

* * * * *